US005182816A

United States Patent [19]

Arai

[11] Patent Number: 5,182,816

[45] Date of Patent: Feb. 2, 1993

[54] SHIELD MOUNTING STRUCTURE FOR HELMET

[76] Inventor: Michio Arai, 1-164, Horinouchi, Ohmiya-shi, Saitama-ken, Japan

[21] Appl. No.: 707,379

[22] Filed: May 30, 1991

[30] Foreign Application Priority Data

Jun. 14, 1990 [JP] Japan ..... 2-156061

[51] Int. Cl.[5] ..... A42B 3/02

[52] U.S. Cl. ..... 2/424

[58] Field of Search ..... 2/424, 425, 410, 5, 2/6, 9, 10

[56] References Cited

U.S. PATENT DOCUMENTS 4,866,792 9/1989 Arai ..... 2/424
4,907,299 3/1990 Arai ..... 2/424
4,920,585 5/1990 Arai ..... 2/424

*Primary Examiner*—Peter Nerbun
*Attorney, Agent, or Firm*—Klauber & Jackson

[57] ABSTRACT

A shield mounting structure is disclosed wherein base plates each having a pivot shaft serve as a pivoting center of a shield and also have a stopper mechanism for restricting a pivoting range of the shield and are provided on both right and left sides of a helmet body, and the shield adapted to rotate about the said pivot shaft to effect opening and closing motions is prevented from dislodgement by means of a shield keep cover provided axially outwards of the pivot shaft and having resilience. Inclined faces for pushing up the shield axially outwards along the axis of the pivot shaft and that of the stopper mechanism are formed on constituent members provided on the base plate, and an opening which permits insertion and removal therethrough of each of mounting portions of the shield is formed between the front edge of the shield keep cover and the outer surface of the helmet body, whereby the mounting and removal of the shield can be done through the said opening while the shield keep cover is left engaged with the helmet body or the base plate.

5 Claims, 12 Drawing Sheets

SHIELD MOUNTING STRUCTURE FOR HELMET

BACKGROUND OF THE INVENTION

1. Field of the Invention

The present invention relates to a shield mounting structure for a full-face type or jet type safety helmet which is used when riding a motorcycle or driving an automobile.

2. Description of the Prior Art

In a conventional shield mounting structure for a full-face type or jet type safety helmet, an opening adjusting means and a shield are generally mounted with set-screws to the helmet body. More specifically, right and left sides of the shield and parts of the opening adjusting means such as a ratchet mechanism are fixedly mounted to the shield through a mounting cover.

In the above conventional structure, when the shield does not open and close (pivot) correctly during touring for example, it is necessary to disassemble a mounting portion of the shield. In this case, when the set-screws are removed to remove the shield mounting cover from the helmet body, various parts for limiting the opening and closing of the shield may fly apart in a disorderly manner and be lost.

In view of the above problem the present inventor previously proposed in Japanese Patent Laid Open No. 309612/88 a mounting structure capable of mounting a shield to the body of a helmet without using set-screws. According to the construction proposed therein, a base plate having a pivot shaft serving as a pivotal center of a shield and also having a stopper (ratchet) mechanism for restricting a pivoting range of the shield is secured to each of right and left sides of a helmet body, the base plate being covered with a shield keep cover so that the shield keep cover is disengaged from the base plate only when the shield assumes a predetermined position (a fully open position).

According to the above prior art, the shield keep cover must be removed at the time of mounting or removal of the shield no matter whether the shield keep cover is a screwed type or of a type in which it is mounted to the base plate by concave-convex engagement. Consequently, the mounting and removal (replacement) of the shield are troublesome, and when the shield keep cover is a set-screw mounted type, the set-screws may be lost. Further, in the case where the shield keep cover is mounted to the base plate by engagement through concave and convex members, the same members may be damaged by frequent operations.

SUMMARY OF THE INVENTION

The present invention has been accomplished in view of the above-mentioned problems of the prior art and it is the object thereof to provide a shield mounting structure whereby the mounting and removal of a shield can be done while a shield keep cover is kept engaged with a helmet body or with a base plate.

According to technical means which the present invention adopted for achieving the above-mentioned object, inclined faces are formed on a pivot shaft and a stopper mechanism both provided projectingly on a base plate fixed to each of right and left sides of the helmet body to push up the shield axially outwards along the axis of the pivot shaft and that of the stopper mechanism to thereby facilitate the engagement and disengagement of the shield with respect to the helmet body when a force of pushing and expanding the shield in a radially leaving direction from the outer surface of the helmet body is exerted on the shield; the shield keep cover is fixed at upper and lower portions thereof to the base plate or the helmet body so that when the aforementioned force is exerted on the shield, a central part of the shield keep cover is pushed and expanded outwards to form a gap between it and the top of the pivot shaft which gap permits the shield to pass therethrough; between the outer surface of the helmet body and the front edge of each shield keep cover there is formed an opening which permits the insertion and removal therethrough of a mounting portion formed on each of right and left sides of the shield, the mounting portions of the shield being each provided with a mounting hole and a stopper part for engagement and disengagement with respect to the pivot shaft and the stopper mechanism, respectively; and when the stopper part comes into abutment with an upper-limit position in the opening motion of the shield, the shield keep cover is pushed and expanded outwards by applying an operation which cannot occur in a normal state of use, to form a gap between the top of the pivot shaft and the inner surface of the shield keep cover which gap permits the shield to pass therethrough, whereby the shield mounting portions can each be mounted to and removed from the base plate through the said gap.

The helmet body to which the aforementioned shield is mounted may be either a full-face type or a jet type.

The base plate which supports the shield may be formed by molding using a synthetic resin material or a metallic material. In the case where a synthetic resin material is used for the molding, a rotation limiting means for limiting the rotation of the shield may be formed integrally with the stopper mechanism which restricts the pivoting range of the shield.

Further, the mounting holes formed on the shield side each for engagement with the pivot shaft formed on the base plate may be in the form of either C shape with part of the peripheral edge cut out or a completely closed circular hole.

According to the above construction, the shield keep cover is mounted at upper and lower portions thereof to the base plate fixed to each of the right and left sides of the helmet body to form an opening between the outer surface of the helmet body and the front edge of the shield keep cover which opening permits the insertion and removal of the shield, so once each shield mounting portion is inserted through the said opening, it is guided into the shield keep cover by the inclined faces of the pivot shaft and the stopper member on the base plate, so that the shield keep cover is pushed up in a leaving direction from the base plate surface by the shield mounting portion, and the mounting hole and the stopper part of the shield mounting portion come into engagement with the pivot shaft and the stopper member on the base plate, respectively.

In this state, the shield is maintained in a set condition under the action of elasticity of the shield keep cover and can be opened and closed. In the range of normal opening and closing motions, the dislodgement of the shield from the helmet body is prevented by the engagement of the mounting hole with the pivot shaft and also by the engagement of the stopper part with the stopper member.

For removing the shield thus mounted, the shield is pivoted up to an upper-limit position of its opening motion, then in this position, an operation which cannot occur in the normal state of use is applied to the shield; more specifically, the shield is moved in a direction to go over the upper-limit position of its opening motion while lifting the shield mounting portions in a leaving direction from the outer surface of the helmet body, whereby the stopper portions are disengaged from the stopper members. Thereafter, when the shield is pulled out in the opening direction, it is guided by the inclined faces, and its mounting holes are disengaged from the pivot shafts on the base plates. Now, the shield mounting portions are in a completely disengaged state from the base plates.

BRIEF DESCRIPTION OF THE DRAWINGS

The drawings illustrate embodiments of the present invention, in which:

FIGS. 13 to 21 illustrate another embodiment, of which:

FIGS. 13 to 17 are partially cut-away perspective views showing a shield mounting sequence; and FIGS. 18 to 21 are partially cut-away perspective views showing in what sequence the shield is removed from the base plate.

DETAILED DESCRIPTION OF PREFERRED EMBODIMENTS

Embodiments of the present invention will be described in detail hereinunder with reference to the accompanying drawings.

Figure 1:
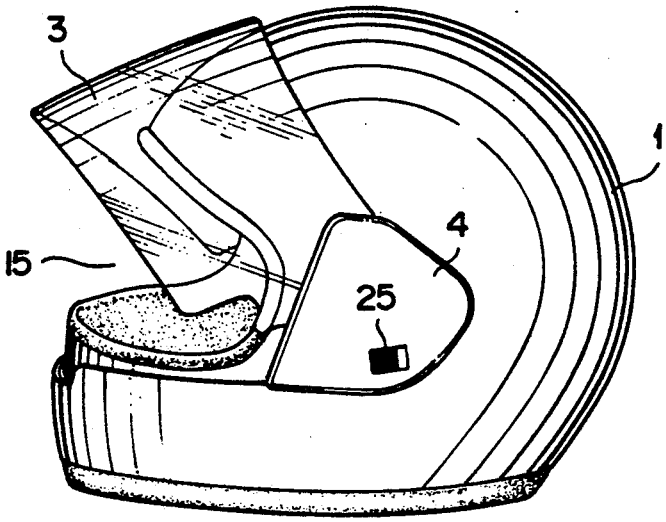
FIG. 1 is a side view of a helmet body and a shield attached thereto.
Figure 2:
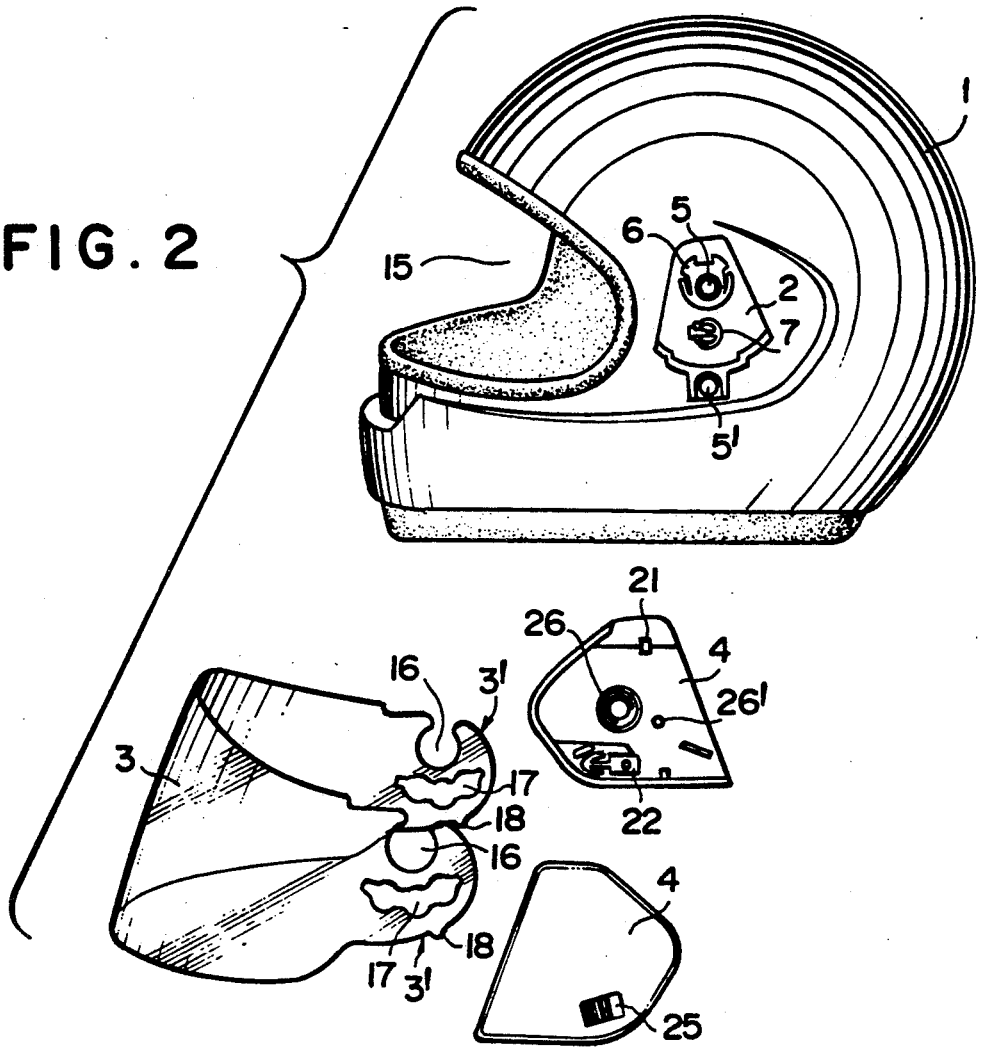
FIG. 2 is an exploded perspective view thereof.
Figure 3:
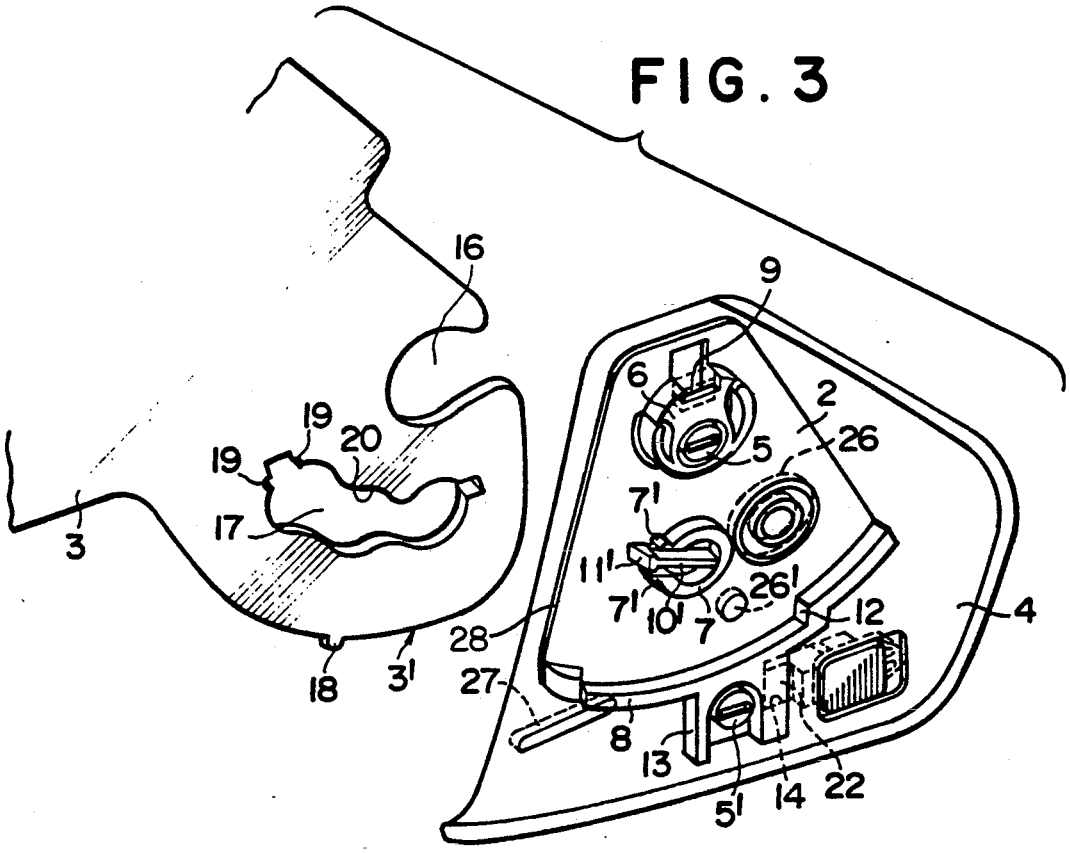
FIG. 3 is an enlarged perspective view showing a shield mounting portion, a base plate and a shield keep cover portion according to an embodiment of the present invention.
Figure 4:
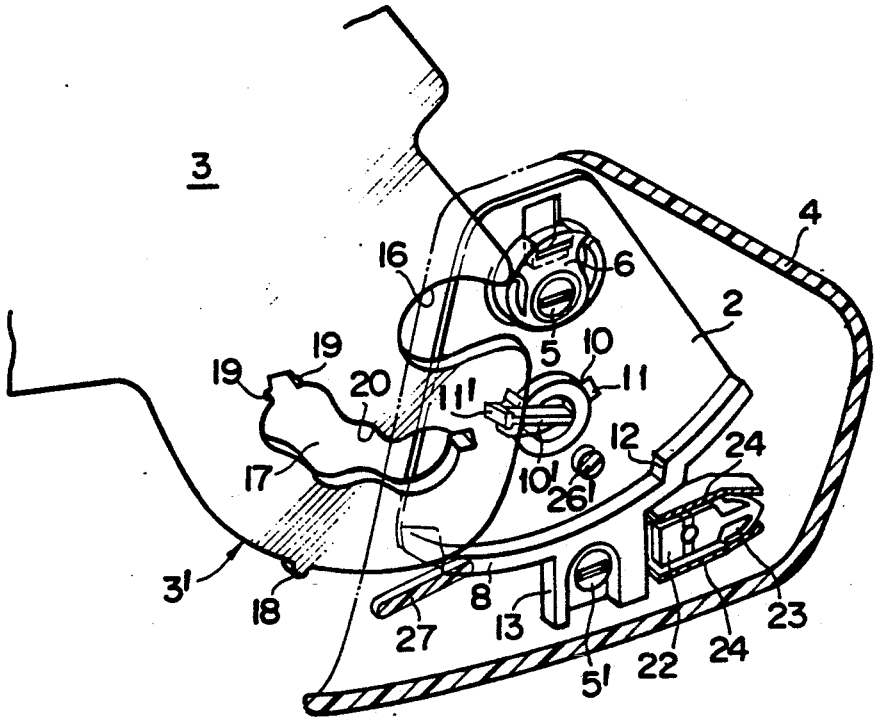
FIGS. 4 to 7 are partially cut-away perspective views showing a shield mounting sequence.
Figure 5:
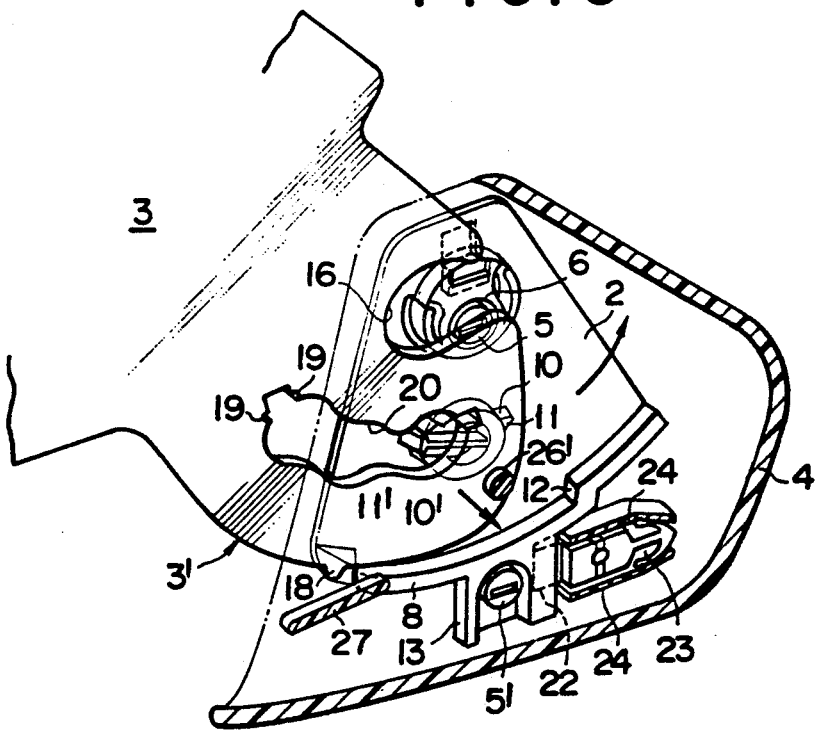
Figure 6:
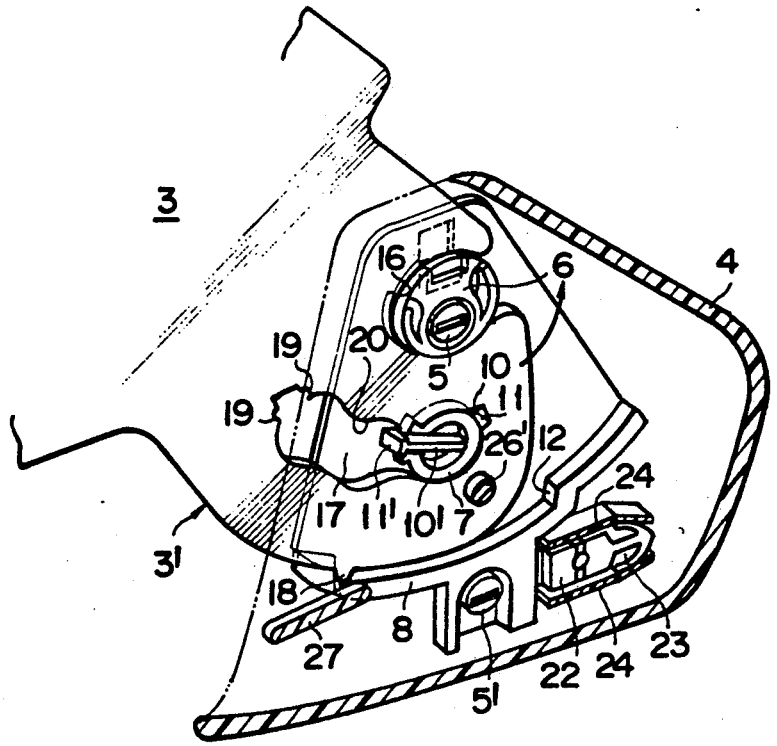
Figure 7:
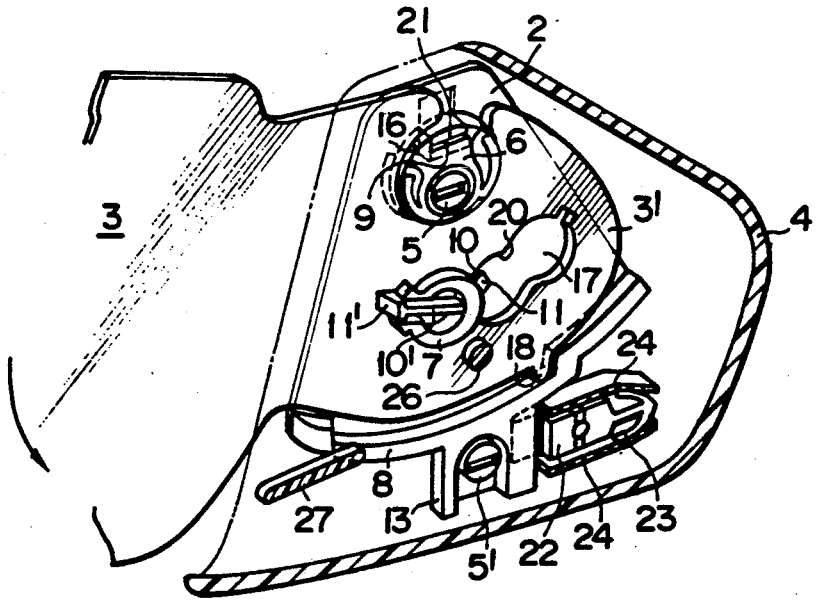
Figure 8:
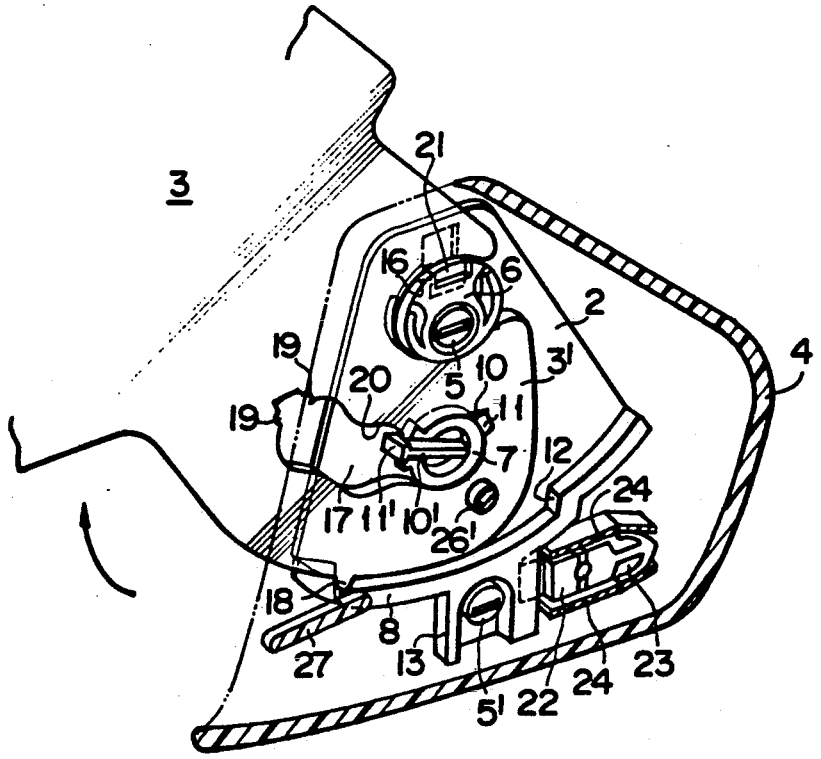
FIGS. 8 to 11 are partially cut-away perspective views showing in what sequence the shield is removed from the base plate.
Figure 9:
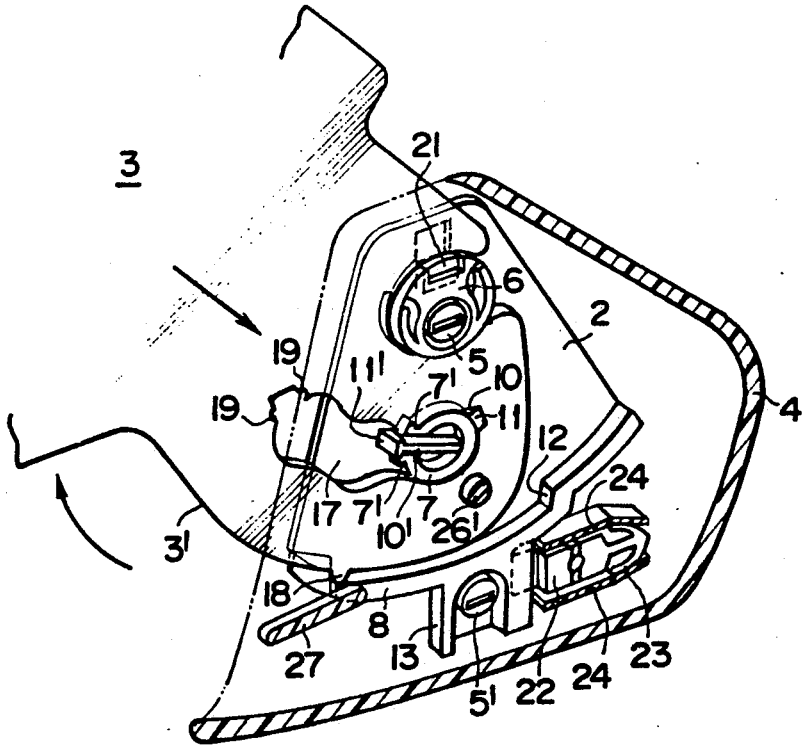
Figure 10:
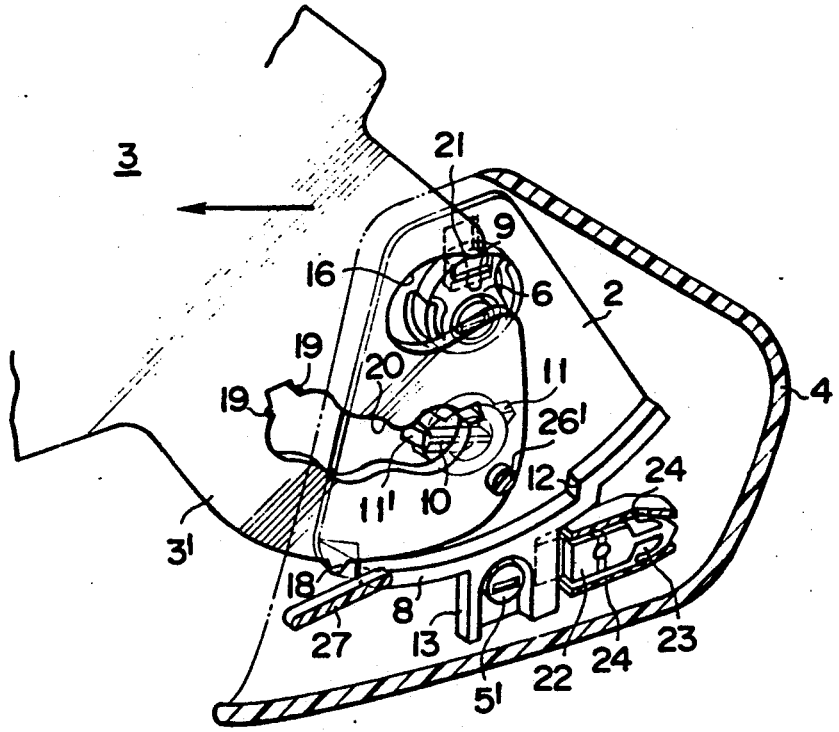
Figure 11:
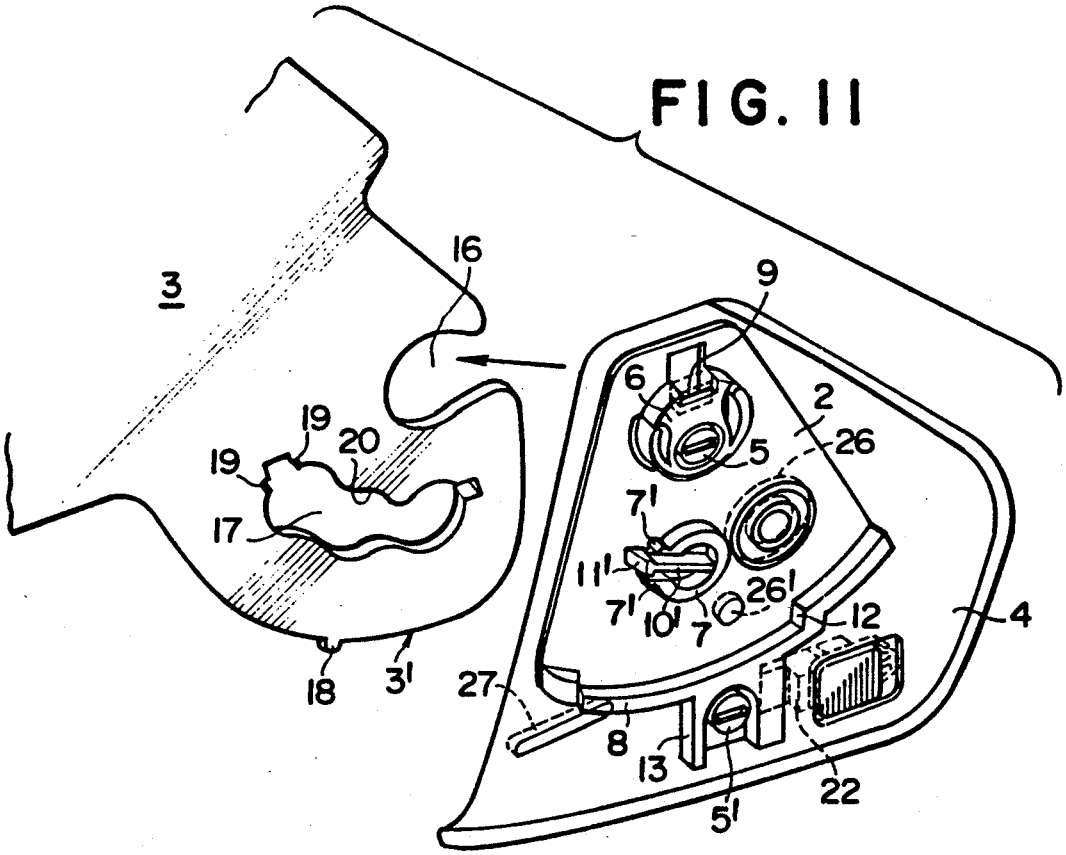
Figure 12:
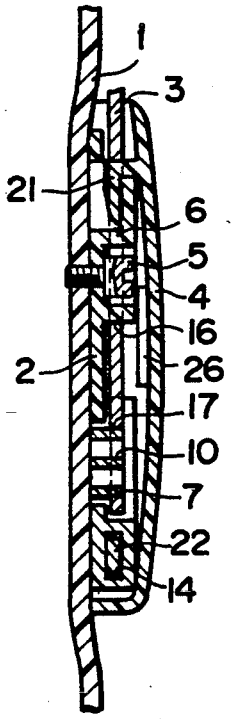
FIG. 12 is a side view in vertical section in a mounted state of the shield.

FIGS. 1 to 12 illustrate a shield mounting structure for a helmet, having C-shaped mounting holes according to an embodiment of the present invention. In the figures, the reference numeral 1 denotes a helmet body; numeral 2 denotes a base plate fixed to each of right and left outer sides of the helmet body 1; numerals 3 and 4 denote a shield and a shield keep cover, respectively. The helmet body 1 has a full-face type configuration which is generally known. The base plate 2 which supports the shield 3 is fixed with set-screws 5 and 5' to each of right and left outer sides of the helmet body 1.

The base plate 2 is provided with a pivot shaft 6 serving as a pivotal center of the shield 3, a resilient engaging piece 7 which not only restricts a pivoting range of the shield 3 but also limits the rotation of the shield, and an arcuately elongated projection 8 for abutting engagement therewith of a stopper part 18 projecting from a lower peripheral edge of the shield 3, the pivot shaft 6, resilient engaging piece 7 and projection 8 being formed integrally with the base plate 2 by resin molding. Below and further below the pivot shaft 6 are disposed the resilient engaging piece 7 and the arcuately elongated projection 8, respectively.

The pivot shaft 6 is projectingly provided in a circular front shape and it is centrally formed with a through hole for insertion of the set-screw therein. On the front side of that through hole there is formed a recess in a stepped shape so that the head of the set-screw 5 can be fitted thereon, and an upper part of the pivot shaft is cut out linearly to form a retaining recess 9, into which is fitted an engaging projection 21.

The resilient engaging piece 7 is formed into a generally C shape in front view by cutting off part of a circular ring. Part of its continuous outer peripheral surface is connected to the base plate 2, while both open side ends of the resilient engaging piece 7 are integrally formed with pawl portions 7' extending radially outwards.

The resilient engaging piece 7 is provided with guide projections 10 and 10' extending respectively from the continuous side toward the open side and from the continuous side toward the outside. Longitudinal side portions of the guide projections 10 and 10' are formed as inclined faces 11 and 11' which are inclined toward the surface of the base plate 2 so that the insertion and removal of the shield 3 can be done smoothly as will be described later.

The arcuately elongated projection 8 is formed in the shape of an arc extending along the lower peripheral edge of the base plate 2, centered on the pivot shaft 6. Halfway in the longitudinal direction of the projection 8 there is formed a stepped portion 12 for abutment therewith of the stopper part 18 of the shield 3.

The position of the stepped portion 12 determines a lower-limit position of the closing motion of the shield 3.

Further formed integrally with the base plate 2 is an overhang portion 13 in a position lower than the arcuately elongated projection 8, the overhang portion 13 having a through hole for insertion of the set-screw 5' therein. In a rear side part of the overhang portion 13 there is formed a retaining hole 14 with which a locking piece 22 formed on the shield keep cover 4 comes into engagement disengageably.

The shield 3 is for opening and closing a window opening 15 formed in the front face of the helmet body 1 and it is formed in conformity with a curved shape of the helmet body, using a transparent or translucent, or colored and transparent, synthetic resin plate. At each of right and left side portions of the shield 3 there are formed a mounting hole 16 for fitting on the pivot shaft 6; an arcuate guide hole 17 in which is fitted the resilient engaging piece 7 to determine a pivoting range of the shield 3; and a mounting portion 3' having a stopper part 18 formed on an outer peripheral edge thereof.

The mounting hole 16 is formed in a generally C shape by cutting off part of the peripheral edge of a circular hole having a diameter a little larger than the outside diameter of the pivot shaft 6.

The arcuate guide hole 17, which is for determining a pivoting range of the shield 3, is formed in an arcuate shape centered on the mounting hole 16 which is fitted on the pivot shaft 6, and in one side portion thereof for engagement with the resilient engaging piece 7 in a closed state of the shield 3 there are formed fitting portions 19 for fitting therein of the pawl portions 7' of the resilient engaging piece 7.

The width of the arcuate guide hole 17 is a little narrower than the outside diameter of the resilient engaging piece 7 in an external force-free state, and a depression 20 is formed halfway in the edge portion of the hole, so that when the shield 3 is rotated and the depression 20 formed in an intermediate position of the arcuate guide hole 17 reaches the position of the resilient engaging piece 7, the engaging piece 7 which has been compressed inwards expands into an unloaded shape thereof and gets into the depression 20, whereby the shield 3 is held in a predetermined open position.

The shield keep cover 4 which covers the mounting portion 3' of the shield 3 is formed of a synthetic resin material, and on an upper part of its inner surface opposed to the mounting portion 3' there is formed an engaging lug 21 integrally, while on a lower part of the said inner surface there is mounted a locking piece 22 so as to be operable from the outside.

The engaging lug 21 is for fitting into the retaining recess 9 formed in the upper side of the pivot shaft on the base plate 2 and it is formed projectingly in a -shape on the back side of the cover body.

The locking piece 22 is a rectangular flat plate and the upper surface of its front portion which fits into and disengages from the retaining hole 14 is cut to form an inclined face, while on the opposite side (rear portion) there is formed a spring piece 23 projectingly in the shape of an arrow, the spring piece 23 urging the locking piece 22 in a direction to fit into the retaining hole 14 at all times. The locking piece 22 is fitted into a guide piece 24 formed on the back of the shield keep cover 4 so that the spring piece 23 is positioned in the rear portion which is smaller in width. As the spring piece 23 moves toward the narrower portion in the guide piece 24, it is pressed inwards to store a biasing force. Upon release of the backward moving force of the spring piece 23, the locking piece 22 is moved in a direction to fit into the retaining hole 14 by the stored biasing force, and thus it comes automatically into engagement with the retaining hole.

An operating plate 25 is fixed to the locking piece 22 in a position outside the shield keep cover 4 so that the operation for disengaging the locking piece 22 from the retaining hole 14 can be done from the exterior of the shield keep cover 4.

Further, lugs 26 and 26' for pressing the mounting portion 3' of the shield 3 to the base plate 2 side are formed in suitable positions of the inner surface of the shield keep cover 4.

In the drawings, the numeral 27 denotes a guide for guiding the mounting portion 3' of the shield 3 at the time of mounting of the mounting portion. The guide 27 is provided on the inner surface of the shield keep cover 4 so as to be positioned outside and in front of the arcuately elongated projection 8 projecting from the outer surface of the base plate 2.

The following description is now provided about mounting and removing operations for the shield in the shield mounting structure described above. First, the shield keep cover 4 is fixed to each of the right and left base plates 2 secured to the helmet body 1, at two upper and lower points through engagement between the retaining recess 9 and the engaging lug 21 and also through engagement between the retaining hole 14 and the locking piece 22, and an opening 28 is defined by both the outer surface of the helmet body 1 and the front edge of the shield keep cover 4.

As the mounting portion 3' of the shield 3 is inserted into the opening 28, the mounting portion 3' is guided inwards of the arcuately elongated projection 8 by the guide 27 projecting from the inner surface of the shield keep cover 4. In this operation, an upper part of the mounting portion 3', or the edge of the mounting hole 16, comes into abutment with the outer peripheral surface of the pivot shaft 6, so that the mounting portion 3' is guided in a direction of abutment with the guide 27. (See FIG. 4.)

With further insertion of the mounting portion 3' of the shield 3, the edge portion of the mounting hole 16 and the arcuate guide hole 17 move onto the pivot shaft 6 and the resilient engaging piece 7, respectively, and the shield keep cover 4 is pushed up in the direction of Z. In this case, the presence of the lugs 26 and 26' gives assistance to this motion. Consequently, the mounting portion 3' further moves to the inside. (See FIG. 5.)

With still further movement of the mounting portion 3' to the interior through the space between the base plate 2 and the shield keep cover 4, the mounting hole 16 reaches the position of the pivot shaft 6, the rear side of the arcuate guide hole 17 reaches the position of the resilient engaging piece 7, and the stopper part 18 reaches the position of the front end of the arcuately elongated projection 8, whereupon the mounting portion 3' is fitted and set to the base plate 2 by the biasing force of the shield keep cover 4. This is confirmed by making a set completion sound, which is a click. (See FIG. 6.)

Mounting of the mounting portion 3' of the shield 3 is completed in the above manner. Now, the shield 3 can rotate vertically about the pivot shaft 6 to open and close the window opening 15 of the helmet body 1. During vertical motions of the shield, the engagement of the mounting portion 3' with the shield 3 is ensured by the engagement between the pivot shaft 6 and the mounting hole 16, the engagement between the resilient engaging piece 7 and the arcuate guide hole 17 and further the engagement between the stopper part 18 and the arcuately elongated projection 8. (See FIG. 7.)

For removing the shield 3 mounted to the helmet body 1, first the shield is turned up to the upper-limit position of its opening motion. (See FIG. 8.)

Then, the shield 3 is moved in a direction to get over the upper-limit position while lifting the mounting portion 3' of the shield 3 in a leaving direction (Z direction) from the outer surface of the base plate 2, and the stopper part 18 is removed from the arcuately elongated projection 8. (See FIG. 9.)

After the stopper part 18 is disengaged from the arcuately elongated projection 8, the shield 3 is pulled out in the direction of arrow, so that the edge portion of the mounting hole 16 becomes disengaged from the pivot 6 and moves onto the upper surface of the pivot shaft, while the rear-side edge of the arcuate guide hole 17 is guided by the inclined face 11 of the guide projection 10 and moves onto the upper surface of the resilient engaging piece 7. (See FIG. 10.)

Then, in this state, the shield 3 is pulled out toward the opening 28, whereby the mounting portion 3' is pulled out completely from between the base plate 2 and the shield keep cover 4. (See FIG. 11.)

Figure 13:
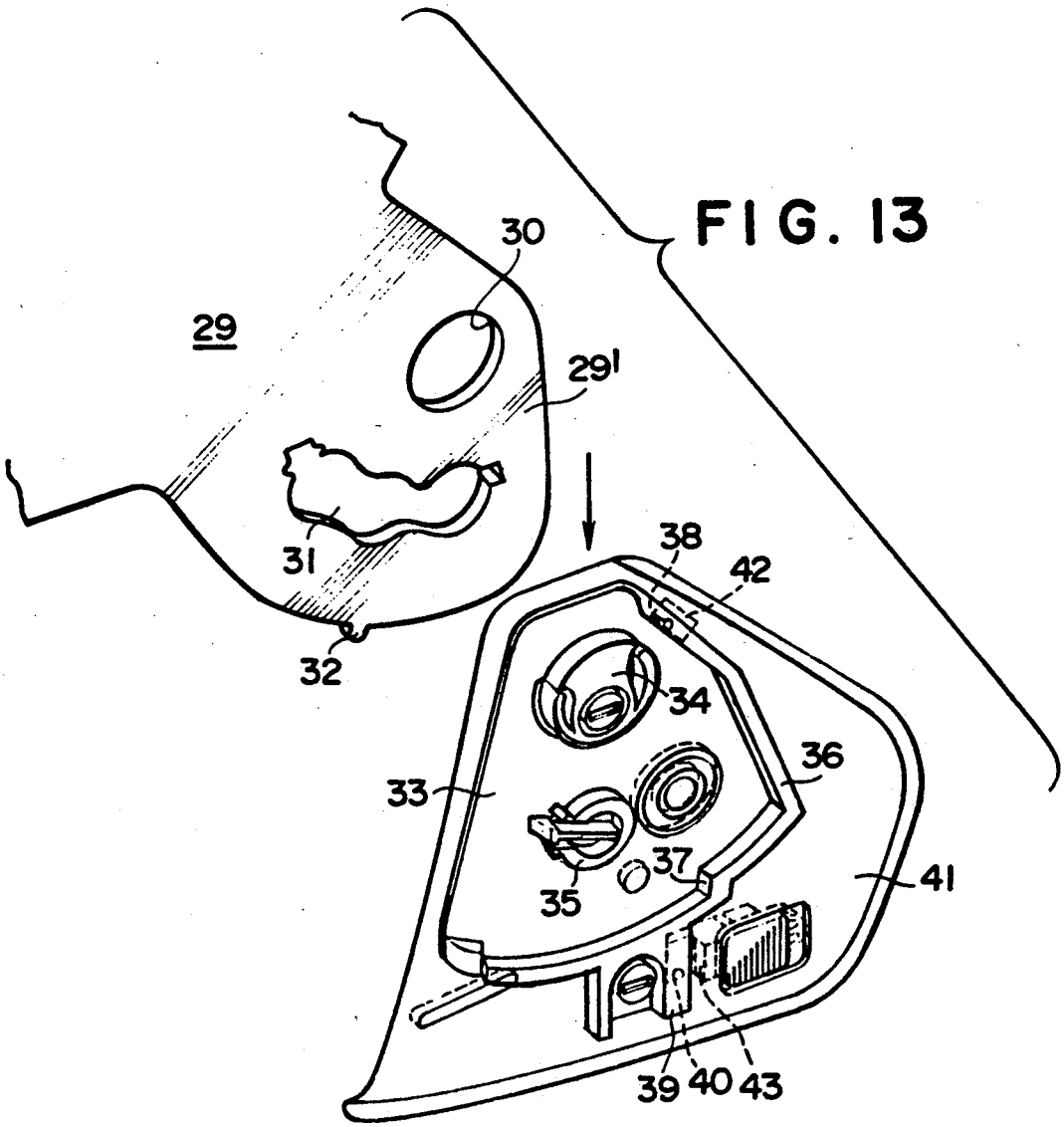
Figure 14:
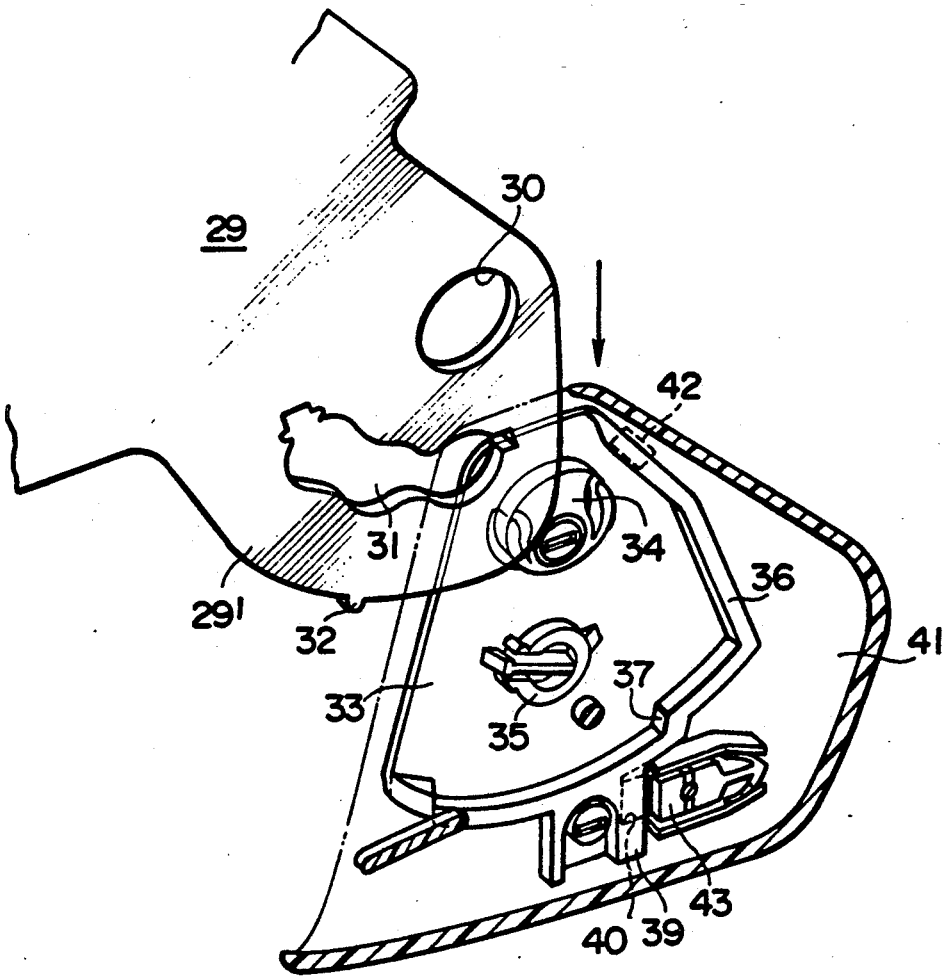
Figure 15:
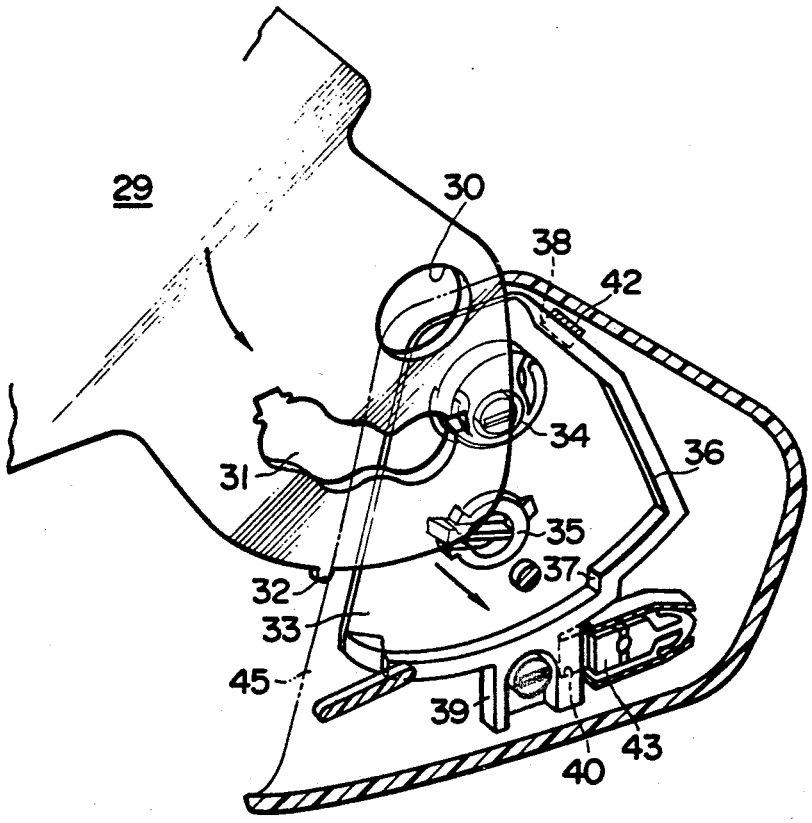
Figure 16:
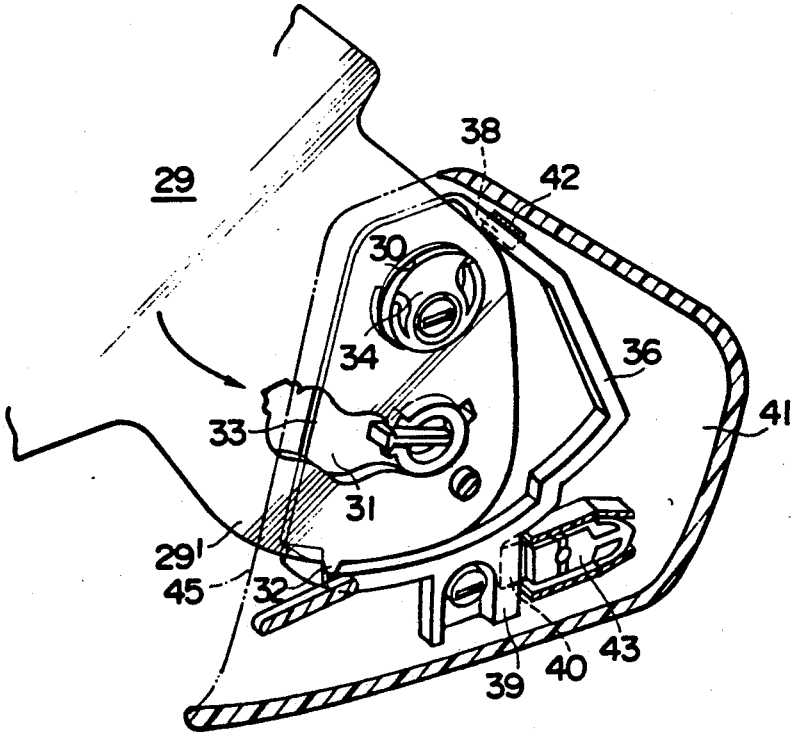
Figure 17:
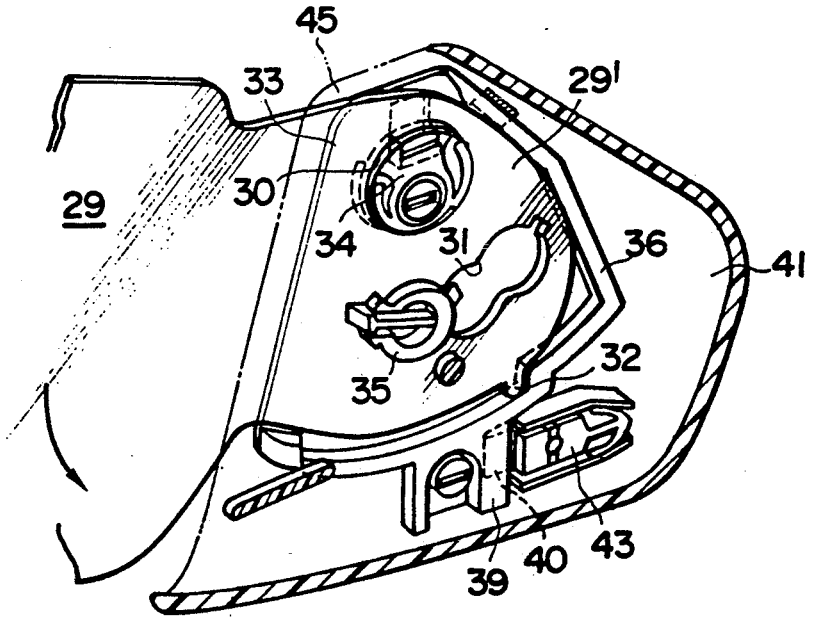
Figure 18:
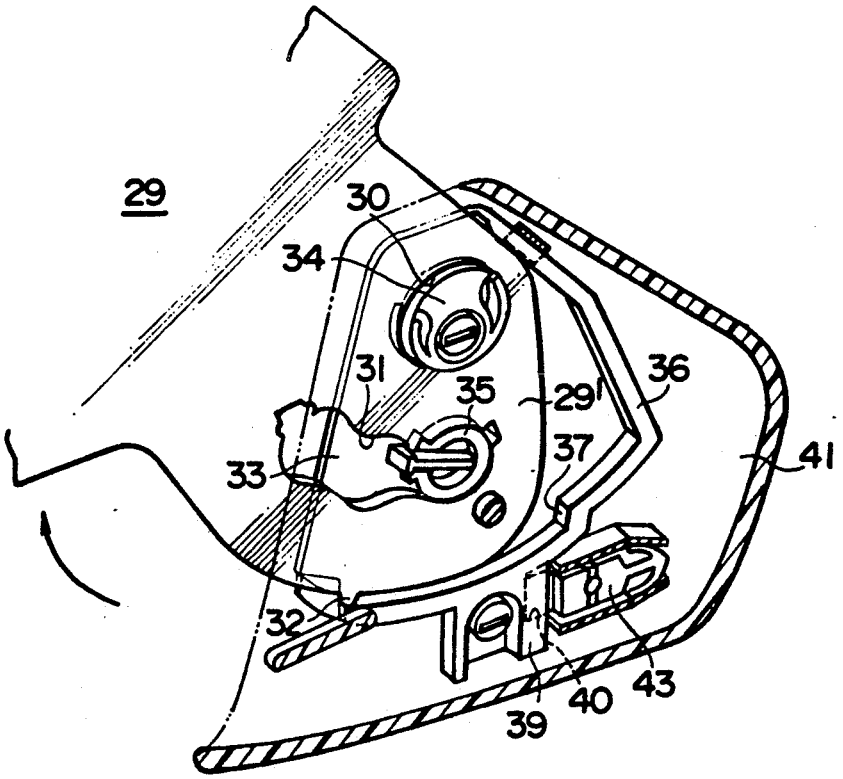
Figure 19:
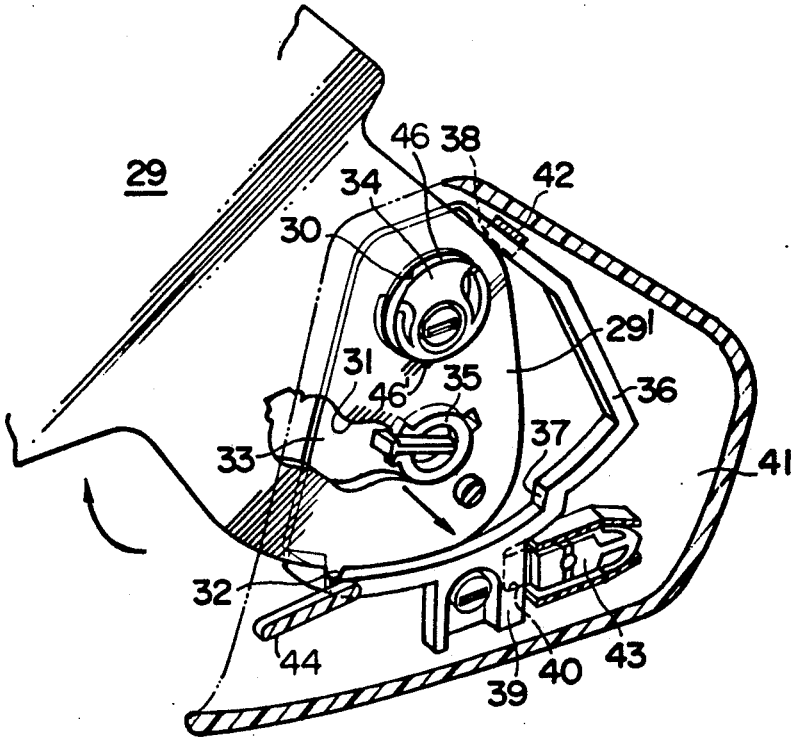
Figure 20:
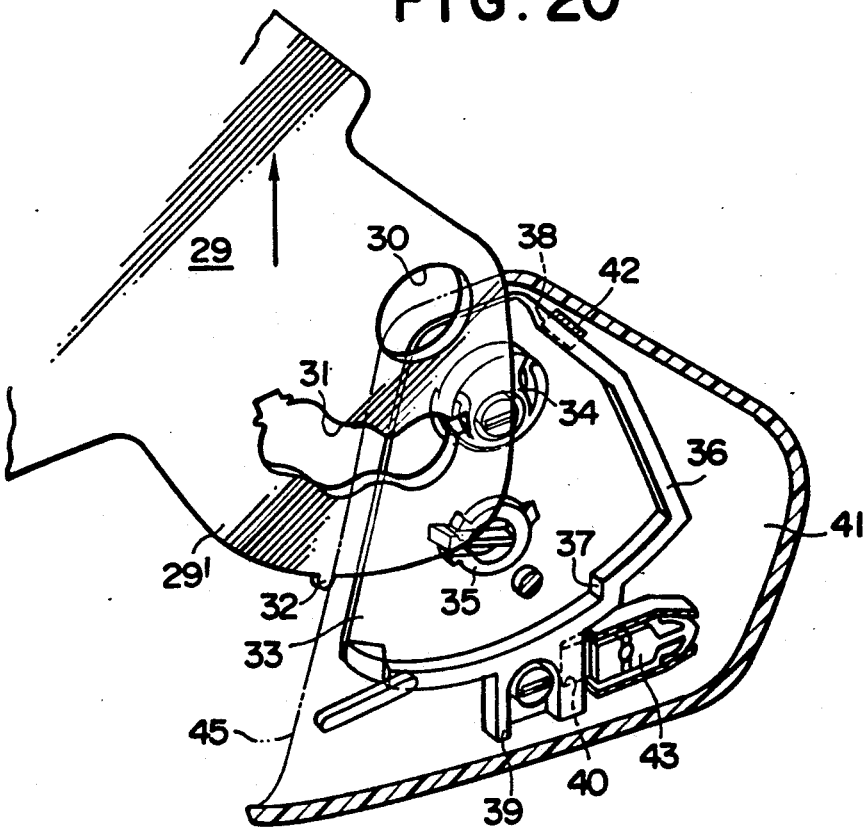
Figure 21:
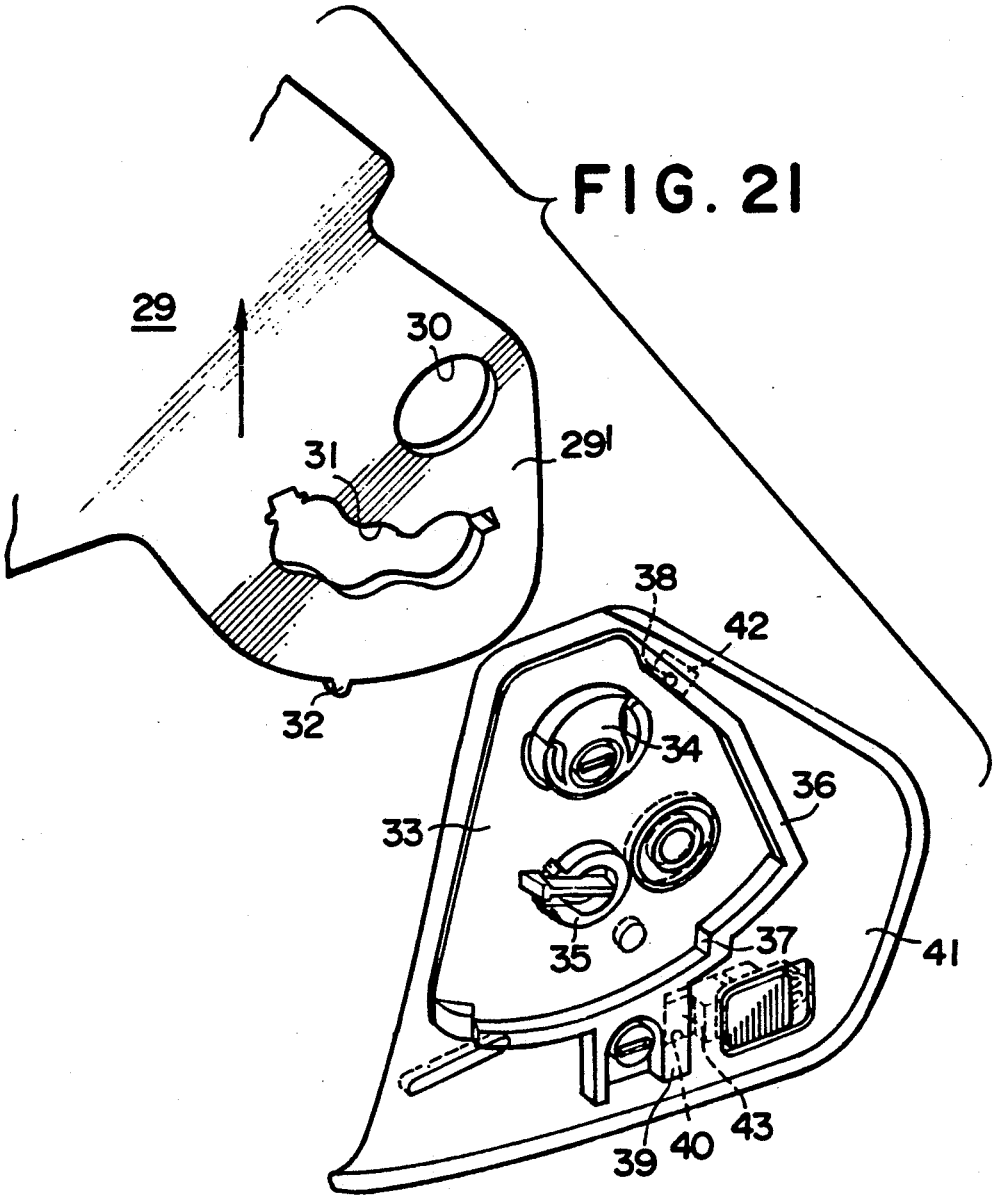

Referring now to FIGS. 13 to 21, there is illustrated a shield mounting structure for a helmet according to another embodiment of the present invention, in which a completely continuous hole is formed as a mounting hole in a shield mounting portion, and an upper fixing position of a shield keep cover is spaced from a pivot shaft.

More specifically, a mounting hole 30 formed in a mounting portion 29' of a shield is a circular hole whose circumference is not cut out at all, while an arcuate guide hole 31 and a stopper part 32 are of the same construction as in the previous embodiment.

As in the previous embodiment, a base plate 33 fixed to a helmet body 1 is provided with a pivot shaft 34 and a resilient engaging piece 35, and an elongated projection 36 is formed on an outside portion of the base plate 33 except upper and front portions. The lower portion of the elongated projection 36 is formed in the shape of an arc centered on the pivot shaft 34 as in the previous embodiment, and a stepped part 37 for abutment therewith of the stopper part 32 is formed in an intermediate position of the elongated projection 36.

A retaining recess 38 is formed in an upper side face of the elongated projection 36 so that an engaging lug 42 of a shield keep cover 41 which will be described later is fitted therein. Means for fixing the lower portion of the shield keep cover is the same as in the previous embodiment; that is, the lower portion of the shield keep cover is fixed by the engagement between a retaining hole 40 formed in an overhang portion 39 extending from the lower portion of the base plate 33 and a locking piece 43 mounted to the shield keep cover 41.

Further, a guide 44 is provided projectingly on an upper inside face of the shield keep cover 41 in conformity with the upper side end of the elongated projection 36 to guide the insertion of the mounting portion 29' of the shield 29. Therefore, the space between both ends of the elongated projection 36 on the base plate 33 provides an opening 45 which is defined in cooperation with the shield keep cover 41.

For setting the mounting portion 29' of the shield 29 in the above construction, the mounting portion 29' is inserted inside the shield keep cover 41 along the guide 44 formed on the inner surface of the shield keep cover. (See FIGS. 13 and 14.)

As the insertion is further continued, the mounting potion 29' moves onto the upper surfaces of the pivot shaft 34 and resilient engaging piece 35 provided on the base plate 33 and pushes up the central portion of the said cover in the direction of Z through lugs formed on the inner surface of the shield keep cover 41, then further moves to the interior. (See FIG. 15.)

When the mounting hole 30 has reached the position of the pivot shaft 34, the rear portion of the arcuate guide hole 31 has reached the resilient engaging piece 35 and the stopper part 32 has reached the lower end portion of the elongated projection 36, they are engaged and set therein by the resilience of the shield keep cover 41. At this instant there is made a click indicating that the setting was completed. (See FIG. 16.)

Through the above operations the mounting of the mounting portion 29' of the shield 29 is completed and the shield 29 is now capable of rotating vertically about the pivot shaft 34, whereby the window opening of the helmet body 1 can be opened and closed. During the above vertical motion of the shield, the mounting portion 29' of the shield 29 is never disengaged from the base plate 33 because of the engagement between the resilient engaging piece 35 and the arcuate guide hole 31 and the engagement between the stopper part 32 and the elongated projection 36.

Removal of the shield 29 once set can be done in the same manner as in the previous embodiment; that is, the shield is turned up to its upper-limit position, then is moved in a direction to get over the upper-limit position while lifting the mounting portion 29' in a leaving direction (Z direction) from the outer surface of the base plate 33, and the shield is then pulled out from the opening 45, whereby the mounting portion 29' is disengaged and pulled out completely from the base plate 33. (See FIGS. 18 to 21.)

In the embodiment just described above, inclined faces 46 and 46' are formed in the upper and lower peripheral edges, respectively, of the pivot 34 so that the insertion and removal of the mounting portion 29' of the shield 29 can be done smoothly.

Since the shield mounting structure of the present invention is constructed as described in detail above, the shield mounting portion can be mounted and removed while the shield keep cover is left fixed to the helmet body or to the base plate secured to the helmet body. Thus, the operation is superior in point of convenience.

Besides, since the shield which has been once set can be removed only after an operation which cannot occur in the normal state of use is applied to the shield in the upper-limit position of the shield opening motion, there is no fear of disengagement of the shield in use.

Moreover, since the mounting (setting) of the shield can be done by only inserting the shield mounting portion into the space between the base plate and the shield keep cover from the opening, the shield mounting structure of the invention is very easy to operate and is convenient.

Further, since the operation for mounting and removal of the shield keep cover is not necessary, there is no fear of loss of set-screws or breakage of convex-concave retaining members.

What is claimed is:

1. A shield mounting structure for a helmet of the type having opposite right and left outer side faces and a front opening, said shield mounting structure comprising:

a) a shield pivotally mounted to said helmet for movement between an open and a closed position, said shield having a right side and a left side, and each side having a mounting portion, an each said mounting portion having a mounting hole and a stopper part, b) a base plate mounted to each of said right and left side faces of said helmet, each said base plate including;

i) a pivot shaft projecting therefrom for pivotally mounting said shield thereon, said pivot shaft having an axis and said pivot shaft being engageable with one said mounting hole, ii) a stopper mechanism projecting therefrom for restricting the range of pivoting motion of said shield, said stopper mechanism being engageable with one said stopper part, c) a resilient shield keep cover associated with each said base plate and helmet body for preventing dislodgement of said shield from each said base plates, each said shield keep cover including:

i) upper and lower portions thereof fixed to one of a respective said base plate and said helmet such that a central part of the shield is pushed and expanded outwardly to form a gap between the shield an the free surface of the pivot shaft when a force is applied to said shield in a removal direction, to permit the shield to pass through said gap, only when said shield is in the upper limit open position, and ii) a front edge, and d) an opening formed between each outer side face of the helmet and each respective front edge of said shield keep covers, which permits the insertion and removal therethrough of one said mounting portion.

2. The shield mounting structure of claim 1 wherein the pivot shafts comprise inclined faces to push the shield outwardly from said base plates in the direction of the axis of said pivot shafts, in order to facilitate engagement and disengagement of the shield with respect to the helmet when a force is applied to the shield in a removal direction.

3. A shield mounting structure for a helmet of the type having opposite right and left outer side faces and a front opening, said shield mounting structure comprising:

a) a shield pivotally mounted to said helmet for movement between an open and a closed position, said shield having a right side and a left side, each side having a mounting portion, and each said mounting portion having a mounting hole and a stopper part, b) a base plate mounted to each of said right and left side faces of said helmet, each said base plate including:

i) pivot shaft means projecting therefrom for pivotally mounting said shield thereon, said pivot shaft means having an axis and said pivot shaft means being engageable with one said mounting hole, ii) stopper means projecting therefrom for restricting the range of pivoting motion of said shield, said stopper means being engageable with one said stopper part, c) resilient shield keep cover means associated with each said base plate for preventing dislodgement of said shield from said base plates, and d) an opening formed between each outer side face of the helmet and said shield keep cover means, which permits the insertion and removal therethrough of one said mounting portion.

4. The shield mounting structure of claim 3 wherein said pivot shafts comprise inclined faces to push the shield outwardly from said base plates in the direction of the axis of said pivot shafts, in order to facilitate engagement and disengagement of the shield with respect to the helmet when a force is applied to the shield in a removal direction.

5. A shield mounting structure for a helmet of the type having opposite right and left outer side faces and a front opening, said shield mounting structure comprising:

a) a shield pivotally mounted to said helmet for movement between an open and a closed position, said shield having a right side and a left side, each side having a mounting portion, and each said mounting portion having a mounting hole and a stopper part, b) a base plate mounted to each of said right and left side faces of said helmet, each said base plate including:

i) pivot shaft means projecting therefrom for pivotally mounting said shield thereon, said pivot shaft means having an axis and said pivot shaft means being engageable with one said mounting hole, and ii) stopper means projecting therefrom for restricting the range of pivoting motion of said shield, said stopper means being engageable with one said stopper part, c) resilient shield keep cover means associated with each said base plate for preventing dislodgement of said shield from said base plates, each said shield keep cover means including:

i) upper and lower portions thereof fixed to one of a respective said base plate and said helmet such that a central part of the shield is pushed and expanded outwardly to form a gap between the shield and the free surface of the pivot shaft when a force is applied to said shield in a removal direction, to permit the shield to pass through said gap, only when said shield in the upper limit open position, and ii) a front edge, and d) an opening formed between each outer side face of the helmet and said shield keep cover means, which permits the insertion and removal therethrough of one said mounting portion.

* * * * *